US005127688A

United States Patent [19]

Eldh

[11] Patent Number: 5,127,688

[45] Date of Patent: Jul. 7, 1992

[54] DOOR HOLDING DEVICE

[76] Inventor: Tage Eldh, P1 2854 Viborg, S-794 00 Orsa, Sweden

[21] Appl. No.: 768,197

[22] PCT Filed: May 28, 1990

[86] PCT No.: PCT/SE90/00353

§ 371 Date: Oct. 25, 1991

§ 102(e) Date: Oct. 25, 1991

[87] PCT Pub. No.: WO90/15214

PCT Pub. Date: Dec. 13, 1990

[30] Foreign Application Priority Data

May 31, 1989 [SE] Sweden ..... 8901953

[51] Int. Cl.[5] ..... E05C 17/24

[52] U.S. Cl. ..... 292/338; 292/278

[58] Field of Search ..... 292/278, 338, DIG. 4, 292/262, 270, 274, 267

[56] References Cited

U.S. PATENT DOCUMENTS 2,188,393 1/1940 Mueller ..... 292/278 X 4,932,695 6/1990 Pettit et al. ..... 292/DIG. 4 X

*Primary Examiner*—Richard E. Moore

*Attorney, Agent, or Firm*—Fleit, Jacobson, Cohn, Price, Holman & Stern

[57] ABSTRACT

A door holding device which includes a rail, a slide mounted on the rail, and a holding rod connected to the slide. When the door is opened, a pivotable latch device is swung to a latching position by means of an abutment member provided on the slide. The door is released by displacing the slide against the action of a spring and the latching device is swung to a release position upon return movement of the slide.

1 Claim, 2 Drawing Sheets

DOOR HOLDING DEVICE

The present invention relates to a door holding device of the kind set forth in the preamble of claim 1.

The object of the present invention is to provide a door holding device which will hold the door automatically in a fully open position and which can be released readily so as to permit the door to be closed, and which is robust and reliable in operation and can be manufactured cheaply.

This object is achieved in accordance with the invention defined in the following claims and described hereinafter with reference to an exemplifying embodiment of an inventive door holding device illustrated in the accompanying drawings, in which FIG. 1 illustrates the inventive device with the door in an open and a closed position respectively;

Figure 1:
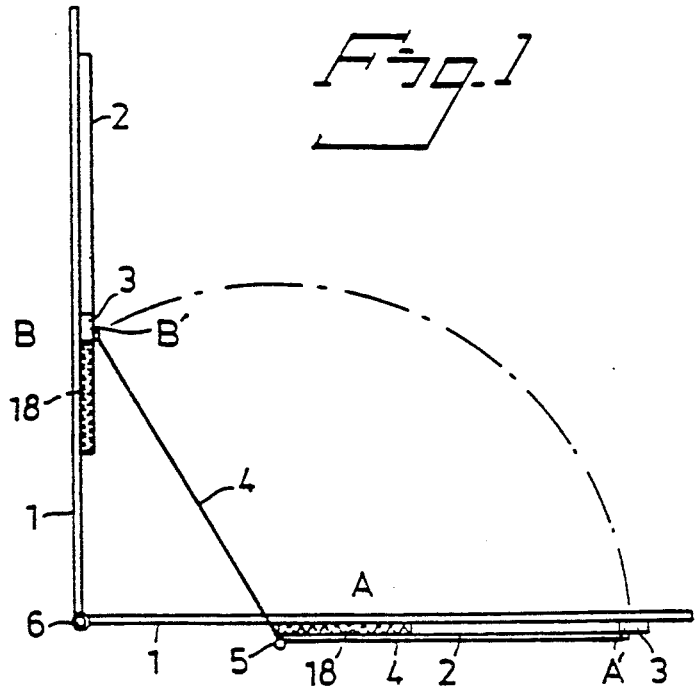

FIG. 1 is a very simplified illustration of the operational state of the inventive device when the door 1 is in a closed position A and a fully open position B. Attached to the door 1 is a rail 2, which in the illustrated embodiment is a C-rail and in which a slide 3 is slidably mounted. The slide 3 is pivotally connected to one end of a holding rod 4. The other end of the holding rod 4 is pivotally connected to a pivot journal 5 mounted on a door frame (not shown) and pivots around the pivot journal 5 in a substantially horizontal plane when the door 1 is opened, said door being mounted on hinges 6. As will be seen from FIG. 1, when the door 1 is swung outwardly, the slide 3 will move in the rail 2 from a first position A' to a second position B', in which the slide 3 is in abutment with a pressure spring 18 and compresses said spring to some extent, as described hereinafter. The slide 3 is latched in the rail 2 in the illustrated position B', so as to prevent the door 1 from closing.

Figure 2:
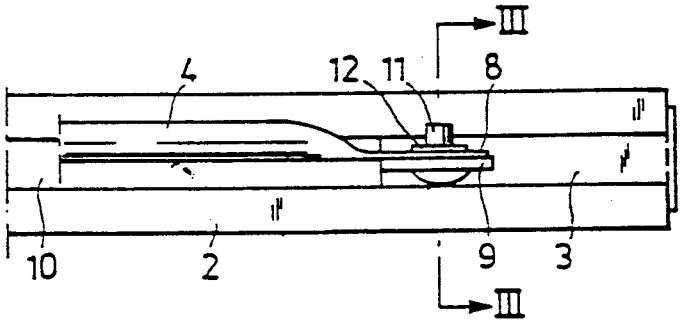
FIG. 2 illustrates that end of a holding rod forming part of said device which is pivotally attached to a slide mounted in the rail fixedly attached to the door.
Figure 3:
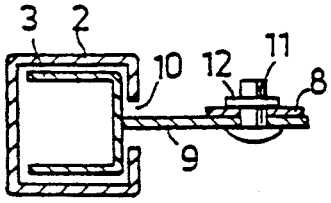
FIG. 3 is a sectional view taken on the line III—III in FIG. 2.
Figure 4:
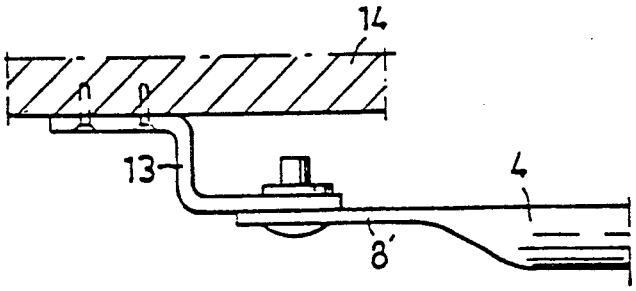
FIG. 4 illustrates the other end of the holding rod, said end being pivotally attached to a door frame.

FIG. 2 illustrates the slide 3 in the position A' and also shows the end of the holding rod 4 connected to said slide. The holding rod 4 has a flat end-part 8 provided with a centrally located hole (not shown). As will best be seen from FIG. 3, the slide 3 is provided with an abutment member 9 which projects out through the central, longitudinally extending channel 10 of the rail 2 and forms an abutment surface for the end-part 8 of said rod. A bolt 11 is inserted through a hole in the abutment member 9 and through a corresponding hole in the end-part 8. The bolt 11 is held in position by means of a lock washer 12 and forms a pivot journal which enables the holding rod to swing relative to the abutment member 9 and therewith relative to the slide 3 and the rail 2. FIG. 4 illustrates the opposite end of the holding rod 4. This opposite end of the rod is also provided with a flat end-part 8', which abuts a flat surface on a bracket structure 13 which is screwed firmly to the upper, horizontal part of the door frame 14, said flat surface extending horizontally in the assembled state of the inventive device. A pivot journal of the same kind as that described above connects the end-part 8' with the bracket structure 13.

When opening the door 1, the holding rod 4 functions to move the slide 3 in the rail 2, from the position A illustrated in FIG. 2 to the door-latching position B, in which the door 1 is fully open.

Figure 5:
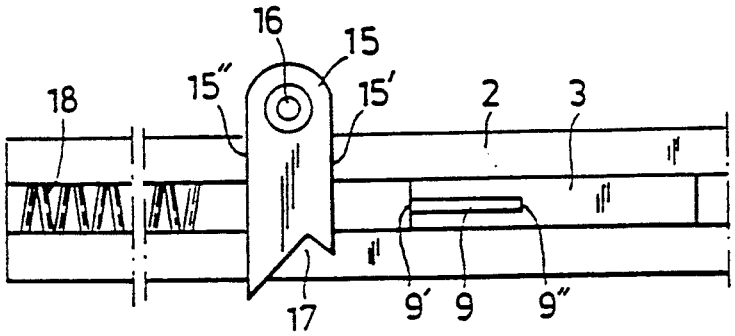
FIG. 5 illustrates the position of the slide when the door is almost fully open.
Figure 6:
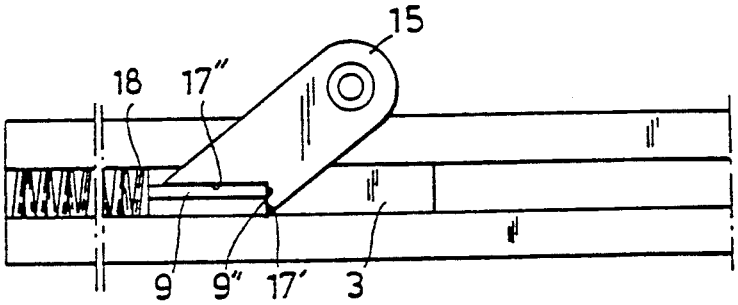
FIG. 6 illustrates coaction of the slide with a latching device pivotally mounted on the rail, and shows the door in a fully open position.

FIGS. 5–6 illustrate a latching device 15 which is freely pivotal on a pivot journal 16 carried on the upper side of the rail 2. The latching device has the form of a plate of uniform thickness and in its non-activated state hangs vertically downwards (FIG. 5). FIG. 5 shows the slide 3 as it approaches the latching position B'. During movement of the slide, the abutment member 9 provided on said slide 3 will reach the edge 15' of the latching device and the latching device will be rotated clockwise, as seen in FIG. 5, and the forwardly located, preferably straight edge 9' of the abutment member (as seen in the direction of movement) will pass beneath and beyond a bottom recess or notch 17 provided in the latching device and reach the position shown in FIG. 6. During at least that part of the movement of the slide 3 during which the freely-pivotable latching device 15 located outwardly of the rail 2 is swunq, said movement takes place against the action of a compression spring 18 or some like spring element, which exerts a large resistive force on the slide. When the abutment member has reached the position illustrated in FIG. 6, the latching device 15 swings anti-clockwise and an wall-part 17' on the recess 17 is moved to a latching position behind the rear edge 9'' of the abutment member. A second wall-part 17'' of the recess 17 passes, at the same time, into engagement with the upper, horizontal surface of the abutment member 9 and prevents the latching device 15 from being swung anti-clockwise by the spring force acting on slide 3 so as to release slide 3 and therewith the latched door 2. In the illustrated embodiment, the recess 17 has the form of a right-angled triangle with one long side 17'' and one short side 17', although it will be understood that said recess may have other configurations. For instance, the side or wall 17'' of the recess 17 may be concave.

Figure 7:
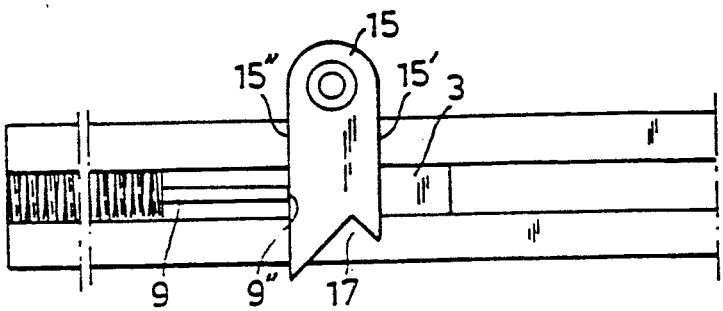
FIG. 7 illustrates a slide position in which the latching device is released.

When wishing to release the door 2 from its latched position, the door is pressed slightly in a clockwise direction in FIG. 1, wherewith the spring 18, which is not fully compressed in the door-latching position, is further compressed by the slide 3, and when the edge 9'' on the abutment member 9 reaches the position shown in FIG. 6, the latching device 15 will swing anti-clockwise to the rest position shown in FIG. 1. When the door 2 is released, the spring 18 will move the slide 3 to the right in FIG. 7, therewith causing the edge 9'' on the abutment member 9 to swing the latching device 15 anti-clockwise from said rest position and said latching device is able to pass freely due to the fact that its bottom part slides freely pivotally on the upper surface of the abutment member.

Although the invention has been described with reference to an exemplifying embodiment thereof, it will be understood that modifications can be made within the scope of the following claims. For instance, the illustrated helical spring 18 can be replaced with a resilient body of any appropriate kind, for example a rubber body.

I claim:

1. A door holding device intended to be fitted to the inside of an outwardly opening door (1) and being of the kind which includes a rail (2) which is provided with a longitudinally extending slot (10) and which can be fitted horizontally to the door adjacent the upper edge surface thereof, a slide (3) which is movable in relation to the rail and which is pivotally connected to one end of a holding rod (4), the other end of which is pivotally mounted to an upper horizontal part of a door frame (14) and, when the door is opened or closed, is moved in a horizontal plane while displacing the slide (3) from a first position (A'), in which the door is closed, to a second position (B'), in which the door is opened, and which further includes a latching mechanism in the form of a pivotable latching device (15) which coacts with an abutment member (9) mounted on the slide (3) and movable relative to the latching device when the door is swung, said abutment member (9) moving together with said slide, wherein the latching device is provided with a bottom recess (17) defined by two abutment parts (17', 17'') of which one abutment part (17') forms a latching surface which in said second position is intended to abut a rear edge surface (9'') on the abutment member, and the other abutment part (17'') is intended to abut an upper horizontal surface on the abutment member in said second position (B'), characterized in that the slide (3) is surrounded by the rail (2) with the abutment member (9) extending out through the longitudinal slot (10) provided in said rail; in that the latching device is mounted so as to be freely pivotable about a pivot pin (16) carried by said rail (2) and located thereabove, such as to hang down in the movement path of the abutment member (9) and can be swung to both sides by the abutment member as said abutment member passes the latching device (15); in that said one end of the holding rod (4) is pivotally connected to the abutment member (9) projecting out from the rail (1); and in that a spring (18) surrounded by the rail (2) and acting between said rail and the slide (3) in the second position (B') of said slide is arranged in a manner such that the door (1) can be swung further in its door opening direction against the action of a spring force so as to push the slide (3) beyond said second position (B') and therewith move the abutment member (9) beyond the latching device (15), so that when the door swings back the rear edge surface (9'') of the abutment member (9) will act on a front edge (15'') of the latching device (15) such as to cause the latching device to swing to one side and the door to be closed.

* * * * *